US010132053B1

(12) United States Patent
Hughes et al.

(10) Patent No.: US 10,132,053 B1
(45) Date of Patent: Nov. 20, 2018

(54) MANHOLE COVER

(71) Applicant: The AES Corporation, Arlington, VA (US)

(72) Inventors: Timothy Michael Hughes, Corona, CA (US); Jason Sean Hoage, Corona, CA (US); Eric Michael Laiblin, Grover Beach, CA (US)

(73) Assignee: THE AES CORPORATION, Arlington, VA (US)

( * ) Notice: Subject to any disclaimer, the term of this patent is extended or adjusted under 35 U.S.C. 154(b) by 0 days.

(21) Appl. No.: 15/652,732

(22) Filed: Jul. 18, 2017

(51) Int. Cl.
*E02D 29/14* (2006.01)
*E02D 29/12* (2006.01)

(52) U.S. Cl.
CPC ..... *E02D 29/1463* (2013.01); *E02D 29/14* (2013.01); *E02D 29/12* (2013.01)

(58) Field of Classification Search
CPC . E02D 29/14; E02D 29/1427; E02D 29/1409; E02D 29/12; E02D 29/1463
See application file for complete search history.

(56) References Cited

U.S. PATENT DOCUMENTS 3,230,844 A * 1/1966 Isaacs ..... E06B 5/01 137/371
3,501,874 A * 3/1970 Hahne ..... G01F 15/12 404/25
3,921,449 A * 11/1975 Hauffe ..... G01F 15/14 137/371
D257,133 S * 9/1980 McKinnon ..... D10/103
4,508,469 A 4/1985 Dumortier
5,529,431 A 6/1996 Walsh
5,864,990 A * 2/1999 Tu ..... E03F 5/06 210/163
6,616,370 B1 * 9/2003 Signorelli ..... B65D 90/48 404/25
6,616,371 B2 * 9/2003 Pate ..... E02D 29/14 137/364
6,718,692 B2 4/2004 McKernan
(Continued)

FOREIGN PATENT DOCUMENTS

EP 1 277 888 A1 1/2003
EP 1 580 328 A2 9/2005
(Continued)

OTHER PUBLICATIONS

Safe-T Lids Temporary Manhole Covers : U-Teck, http://www.uteck.com/safe-t-lid-temporary-manhole-covers/, 3 Pages.
(Continued)

*Primary Examiner* — Abigail A Risic
(74) *Attorney, Agent, or Firm* — Buchanan Ingersoll & Rooney PC

(57) ABSTRACT

A manhole cover including: a frame located at the edges of the manhole cover which completely surrounds the manhole cover; a plurality of slats that are spaced apart and parallel to each other; a plurality of lateral bracings that are spaced apart and parallel to each other, wherein the lateral bracings are perpendicular to the slats; and a hinged access portion located in the center of the manhole cover that is connected to a main portion of the manhole cover by a hinge, and all edges of the hinged access portion are spaced away from the frame.

22 Claims, 4 Drawing Sheets

Type I

(56) References Cited

U.S. PATENT DOCUMENTS

| | | | | |
|---|---|---|---|---|
| 6,893,186 | B1 | 5/2005 | Tello, Sr. | |
| 7,303,354 | B1 | 12/2007 | DeCroix | |
| 7,866,915 | B2 | 1/2011 | Pendleton et al. | |
| 8,292,540 | B2 | 10/2012 | Pickavance et al. | |
| 8,511,930 | B2 | 8/2013 | Royer et al. | |
| 2004/0182004 | A1* | 9/2004 | Gowland | E02D 29/1427 49/33 |
| 2014/0227030 | A1* | 8/2014 | Beaudoin | E02D 29/1454 404/4 |
| 2016/0168818 | A1* | 6/2016 | Harazim | E02D 29/14 404/25 |

FOREIGN PATENT DOCUMENTS

| | | | |
|---|---|---|---|
| GB | 2 262 557 | A | 6/1993 |
| GB | 2 463 666 | A | 3/2010 |

OTHER PUBLICATIONS

NewsRx, "Saint-Gobain Pam; Patent Issued for Manhole Assembly and Related Method," Nov. 2012, 8 pages, http://dialog.proquest.com/professional/printviewfile?accountid=157282, retrieved on Feb. 6, 2017.

EJ, "Product Catalogue No. 4", Jun. 2013, 112 pages, https://emea.ejco.com/wcsstore/EUROPE/EJEuropeAssets/DigitalDownloads/DD_Content/UK/Content_Ireland%20Product%20Catalogue%20No%204.pdf, retrieved on Feb. 6, 2017.

Syndigate Media Inc., "Damages sought over child's injury", Jul. 2016, 3 pages, http://dialog.proquest.com/professional/docview/1805842458?accountid=157282, retrieved on Feb. 6, 2017.

ACO, "ACO Systems Brochure", 28 pages, http://www.aco.ae/fileadmin/ae_aco/documents/ACO_Systems_ductile_iron_brochure_small.pdf, retrieved on Feb. 6, 2017.

* cited by examiner

Type I

Type II

Type III

Type IV

MANHOLE COVER

FIELD

The present disclosure relates to a manhole cover.

BACKGROUND

Manhole covers having different designs currently exist. However, there is a need for manhole cover in which a user can safely access the hole below without the risk of falling into the hole and being injured.

SUMMARY

An exemplary embodiment of the present disclosure provides a manhole cover including: a frame located at the edges of the manhole cover which completely surrounds the manhole cover; a plurality of slats that are spaced apart and parallel to each other; a plurality of lateral bracings that are spaced apart and parallel to each other, wherein the lateral bracings are perpendicular to the slats; and a hinged access portion located in the center of the manhole cover that is connected to a main portion of the manhole cover by a hinge, and all edges of the hinged access portion are spaced away from the frame.

BRIEF DESCRIPTION OF THE DRAWINGS

The scope of the present disclosure is best understood from the following detailed description of exemplary embodiments when read in conjunction with the accompanying drawings.

DETAILED DESCRIPTION

Figure 1C:
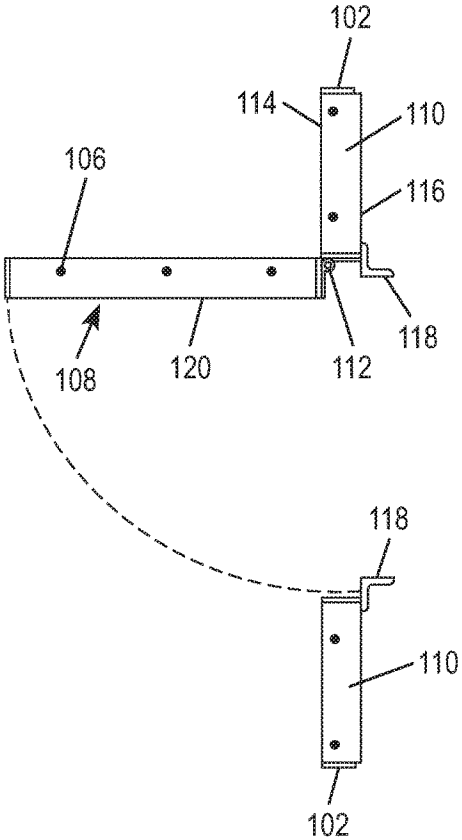
FIG. 1C is a side sectional view of a manhole cover in accordance with an exemplary embodiment.
Figure 1B:
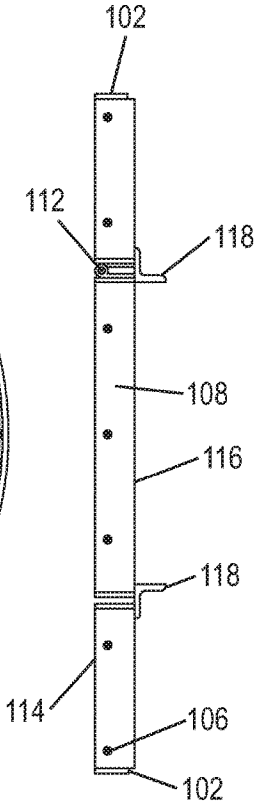
FIG. 1B is a side sectional view of a manhole cover in accordance with an exemplary embodiment.
Figure 1A:
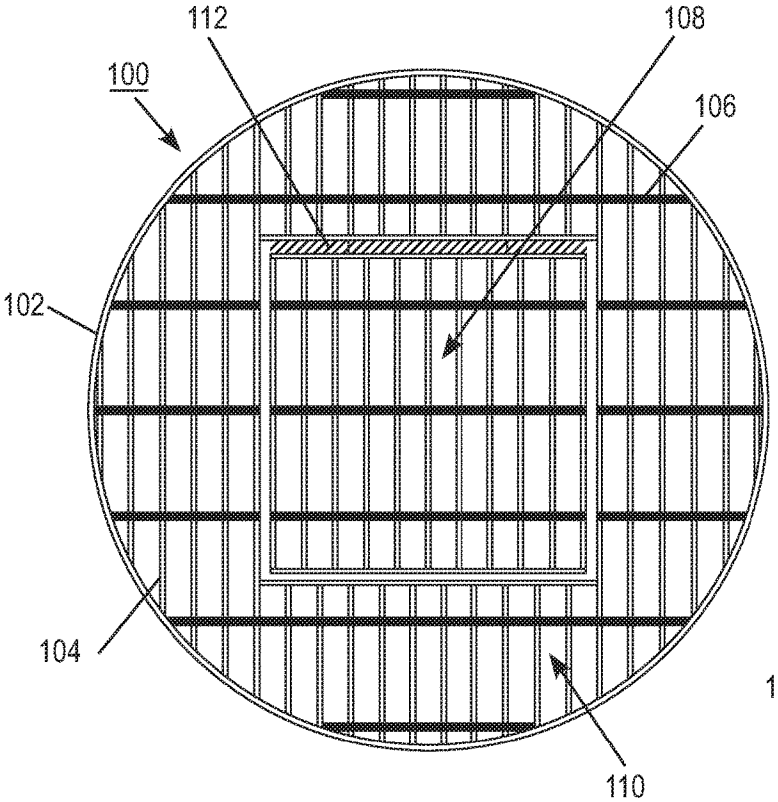
FIG. 1A is a top plan view of a manhole cover in accordance with an exemplary embodiment.
Figure 2B:
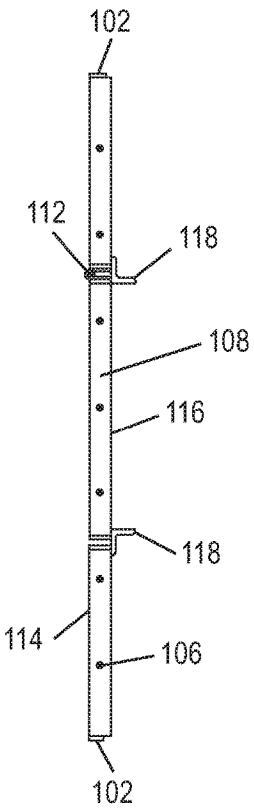
FIG. 2B is a side sectional view of a manhole cover in accordance with an exemplary embodiment.
Figure 2A:
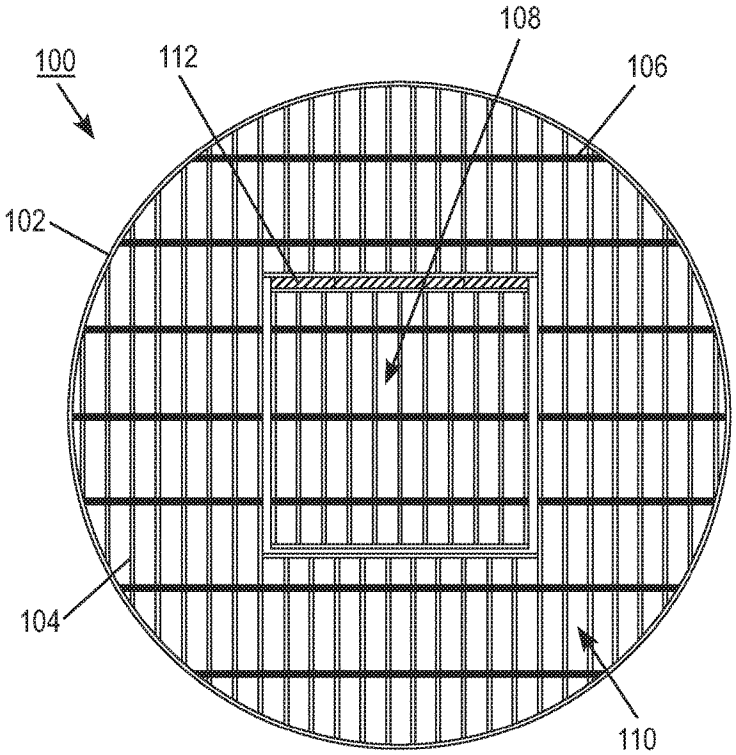
FIG. 2A is a top plan view of a manhole cover in accordance with an exemplary embodiment.
Figure 3B:
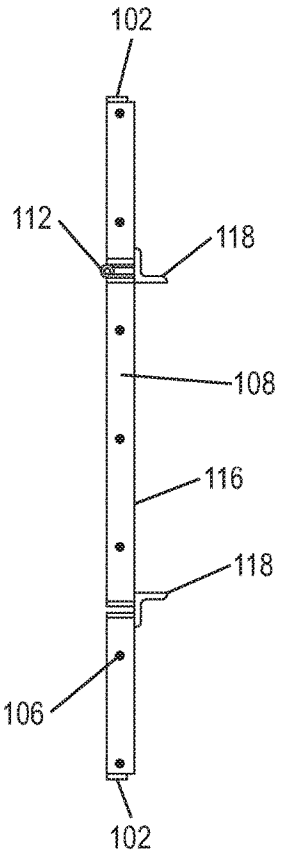
FIG. 3B is a side sectional view of a manhole cover in accordance with an exemplary embodiment.
Figure 3A:
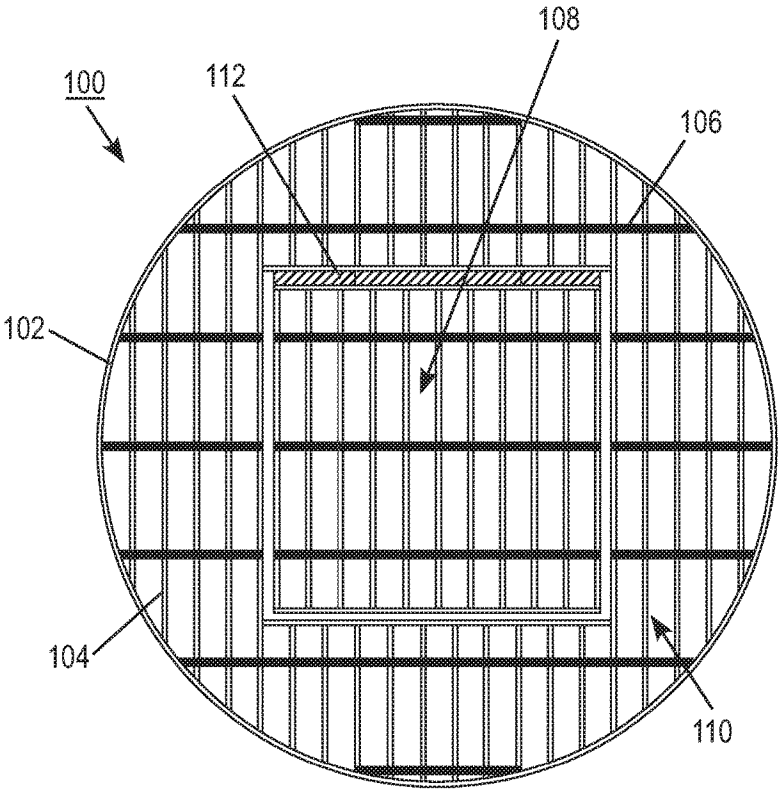
FIG. 3A is a top plan view of a manhole cover in accordance with an exemplary embodiment.
Figure 4B:
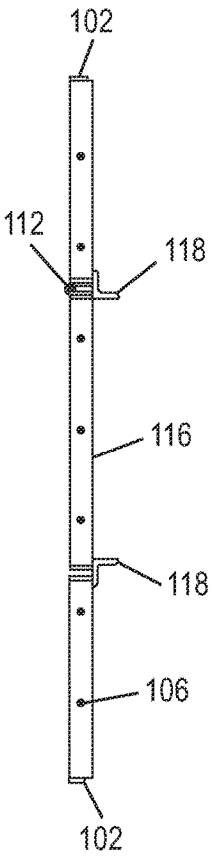
FIG. 4B is a side sectional view of a manhole cover in accordance with an exemplary embodiment.
Figure 4A:
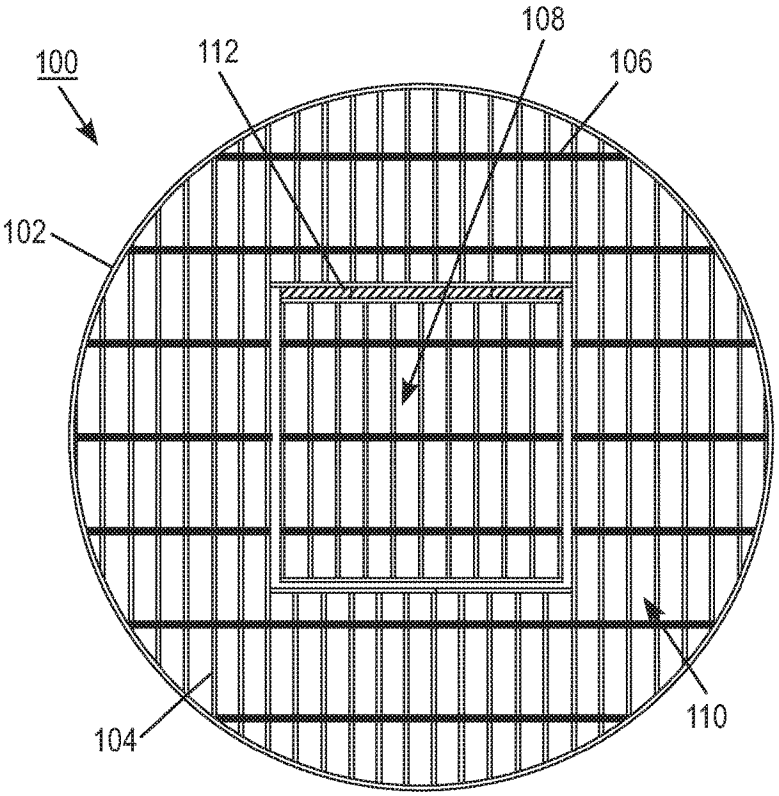
FIG. 4A is a top plan view of a manhole cover in accordance with an exemplary embodiment.

The present disclosure is directed to a manhole cover 100 that reduces the risk of falling into an open manhole. The manhole cover 100 can be a temporary manhole cover that is placed over the manhole when work is being done, such as when an underground utility vault is being cleaned out with a sump pump to remove water and debris. FIGS. 1A, 1B, and 1C show an embodiment directed to an AES Type Imanhole cover. FIGS. 2A and 2B show an embodiment directed to an AES Type II manhole cover. FIGS. 3A and 3B show an embodiment directed to an AES Type III manhole cover. FIGS. 4A and 4B show an embodiment directed to an AES Type IV manhole cover. The present disclosure is not limited to these exemplary embodiments.

In an exemplary embodiment shown in FIGS. 1A, 1B, and 1C, for example, the manhole cover 100 includes a frame 102 located at the edges of the manhole cover 100 which completely surrounds the manhole cover 100. The manhole cover 100 also includes a plurality of slats 104 that are spaced apart and parallel to each other. The manhole cover 100 also includes a plurality of lateral bracings 106 that are spaced apart and parallel to each other. In an exemplary embodiment, the lateral bracings 106 are perpendicular to the slats 104. However, the later bracings 106 can be non-perpendicular to the slats 104. The manhole cover 100 also includes a hinged access portion 108 located in the center of the manhole cover 100 that is connected to a main portion 110 of the manhole cover 100 by a hinge 112. In an exemplary embodiment, all edges of the hinged access portion 108 are spaced away from the frame 102. However, one or more edges of the hinged access portion 108 can be in contact with the frame 102.

In an exemplary embodiment, the hinged access portion 108 has an area of one square foot or less. An advantageous feature of the disclosed manhole covers is that the hinged access portion having an area of one square foot or less reduces the probability of a risk of injury due to a fall into an open manhole (for example, when cleaning out an underground utility vault with a sump pump to remove water and debris from the underground utility vault). The manhole safety grating can reduce the area of exposure by approximately 80 percent, as a typical 2.5 foot diameter manhole has an opening of 4.9 square feet or less. The reduction in the area of exposure is a function of the diameter of the manhole, which determines the total square footage as the denominator and the hinged access portion having an area of one square foot as the numerator.

In an exemplary embodiment, the hinged access portion 108 is rectangularly shaped. In an exemplary embodiment, the hinged access portion 108 is square shaped as shown in FIGS. 1A, 2A, 3A, and 4A. As seen in FIGS. 1A, 2A, 3A, and 4A, the hinged access portion 108 has a frame at its edges.

In an exemplary embodiment, the manhole cover 100 has an upper surface 114 and a lower surface 116, and the hinge 112 is located completely within the upper surface 114 and the lower surface 116. See FIGS. 1B and 1C. As seen in FIGS. 2B, 3B, and 4B, the hinge 112 can protrude above the upper surface 114 of the manhole cover 100.

In an exemplary embodiment, the hinge 112 is parallel to the lateral bracings 106. See FIGS. 1A, 2A, 3A, and 4A. The hinge 112 can be perpendicular to the lateral bracings 106.

In an exemplary embodiment, the hinge 112 is continuous along the length of the hinged access portion 108. See FIGS. 1A, 2A, 3A, and 4A. However, the hinge 112 can be made up of one or more sections that may or may not have a gap between the one or more sections. For example, the hinge 112 can be made up of three sections.

In an exemplary embodiment, the lower surface 116 has at least two supporting pieces 118 that support a lower surface 120 of the hinged access portion 108 when it is in the closed position. See FIGS. 1B, 2B, 3B, and 4B. In an exemplary embodiment, the at least two supporting pieces 118 are L-shaped brackets. Each L-shaped bracket can be, for example, 1.25×1.25×0.25 inches. However, the at least two supporting pieces 118 can be any shape or have any dimension, for example, the L-shaped brackets can be triangular, rectangular, square, etc. FIG. 1C shows the hinged access portion 108 when it is being opened. As seen in FIG. 1C, the hinged access portion 108 opens towards the upper surface 114 of the manhole cover 100. In an exemplary embodiment, when fully opened, the top of the hinged access portion 108 is in contact with the upper surface 114 of the manhole cover 100. As seen in FIGS. 1B, 1C, 2B, 3B, and 4B, the at least two supporting pieces 118 are parallel to the lateral bracings 106.

In an exemplary embodiment, shown in FIGS. 1A, 2A, 3A, and 4A, the frame 102 is circular. However, the frame 102 can be any shape. For example, the frame 102 can be shaped as a rectangle, square, pentagon, hexagon, octagon, etc.

In an exemplary embodiment, the lateral bracings 106 are cylindrical rods that are connected to two portions of the frame 102 and to some or all of the plurality of slats 104. However, the lateral bracings 106 can be any shape. For example, they could have a rectangular or square cross-section, etc. The lateral bracings 106 can be welded to the frame 102. The slats 104 can also be welded to the lateral bracings 106. In FIGS. 1A, 1B, and 1C, the lateral bracings 106 are equally spaced apart from each other. For example, the lateral bracings 106 can be spaced 4 inches from each other. However, one or more of the lateral bracings 106 can be spaced different distances from each other depending upon the design load and diameter of the manhole.

In an exemplary embodiment, the number of lateral bracings 106 is between 1 and 50, for example between 5 and 9. As seen in FIGS. 1B and 1C, all of the lateral bracings 106 are in the same horizontal plane. However, the number of lateral bracings can vary depending upon the design load and diameter of the manhole. Furthermore, one or more of the lateral bracings 106 can be in different horizontal planes.

In an exemplary embodiment, the slats 104 are equally spaced apart from each other. For example, the slats 104 can be spaced 1.1875 inches from each other. However, one or more of the slats 104 can be spaced different distances from each other depending upon the design load and diameter of the manhole. In an exemplary embodiment, the number of slats 104 is between 1 and 50, for example between 18 and 28.

In an exemplary embodiment, the manhole cover 100 is 1 to 12 inches thick, and the slats 104 have a height of 1 to 12 inches. Alternatively, the manhole cover 100 is 1 to 1.5 inches thick, and the slats 104 have a height of 1 to 1.5 inches. Also, the manhole cover 100 can be 1 to 12 inches thick (e.g., 0.75 to 1.75 inches thick), and the slats 104 have a height of 1 to 12 inches (e.g., 0.75 to 1.75 inches). For example, in FIGS. 1A, 1B, and 1C, the manhole cover 100 is 1.5 inches thick and the slats 104 have a height of 1.5 inches. In FIGS. 2A, 2B, 3A, 3B, 4A, and 4B, the manhole covers 100 are 1 inch thick and the slats 104 have a height of 1 inch. All of these dimensions can vary based upon the design load and diameter of the manhole.

In an exemplary embodiment, the frame 102 is circular and has a thickness in the radial direction of 1 inch to 6 inches.

As seen in FIGS. 1B, 2B, 3B, and 4B, the manhole cover 100 has a uniform thickness (i.e., from the upper surface 114 of the manhole cover to the lower surface 116 of the manhole cover).

In an exemplary embodiment, the manhole cover 100 is made of aluminum, steel, iron, or composite. However, the manhole cover 100 can be made of any material. For example, steel, iron, composite, etc. The manhole cover 100 can be traffic-rated or not traffic-rated.

The manhole cover 100 of FIGS. 1A, 1B, and 1C, which is an AES Type I manhole cover, has a diameter of 25.75 inches. The open area of the manhole cover 100 is 12 inches or less wide by 12 inches or less deep. Because the open area of the manhole cover 100 is 12 inches or less wide by 12 inches or less deep, the manhole cover 100 falls under the definition of a "floor hole" by the Occupational Safety and Health Administration (OSHA). Under 29 C.F.R. 1910.21, OSHA defines a "floor hole" as any opening measuring between 1 and 12 inches at its smallest point through which materials, but not people, can fall. A "floor opening," however, measures a minimum of 12 inches at its smallest point. This definition does not describe how far a person or material must fall once through the opening or hole. This is important, because under 29 C.F.R. 1910.23, floor holes and openings must be guarded with railings or covers if a person can step into or through the hole. For holes in close proximity to equipment or walls, a cover must be provided to leave no opening more than 1 inch wide. Under OSHA, any floor opening to a stairway must be guarded on all exposed sides (except, of course, the entrance) by standard railings and toeboards. In place of permanent railings, a hinged cover and removable railings may be used to prevent falls. If no railings are present and any floor opening is to remain uncovered, it must be continuously attended so as to prevent anyone from walking into the opening The hinged access portion 108 is less than 12 inches wide (i.e., from left to right in the figures) and less than 12 inches deep (not including the hinge 112). For example, the hinged access portion 108 can be, for example, 11.1875 inches wide and 11.25 inches deep. The diameter of the hinge 112 can be, for example, 0.5 inch. The manhole cover 100 of FIG. 1A has 22 slats and 7 lateral bracings 106. The slats are 1.5 inches thick (i.e., from top to bottom) and 0.1875 inch wide.

The manhole cover 100 of FIGS. 2A and 2B, which is an AES Type IImanhole cover, has a diameter of 31 inches. The open area of the manhole cover 100 is 12 inches or less wide by 12 inches or less deep. The hinged access portion 108 is less than 12 inches wide (i.e., from left to right in the figures) and less than 12 inches deep (not including the hinge 112). For example, the hinged access portion 108 can be, for example, 11.1875 inches wide and 11.25 inches deep. The diameter of the hinge 112 is 0.5 inch. The manhole cover 100 of FIG. 2A has 26 slats and 7 lateral bracings 106. The slats are 1 inch thick (i.e., from top to bottom) and 0.1875 inch wide.

The manhole cover 100 of FIGS. 3A and 3B, which is an AES Type III manhole cover, has a diameter of 25.1875 inches. The open area of the manhole cover 100 is 12 inches or less wide by 12 inches or less deep. The hinged access portion 108 is less than 12 inches wide (i.e., from left to right in the figures) and less than 12 inches deep (not including the hinge 112). For example, the hinged access portion 108 can be, for example, 11.1875 inches wide and 11.25 inches deep. The diameter of the hinge 112 is 0.5 inch. The manhole cover 100 of FIG. 3A has 20 slats and 7 lateral bracings 106. The slats are 1 inch thick (i.e., from top to bottom) and 0.1875 inch wide.

The manhole cover 100 of FIGS. 4A and 4B, which is an AES Type IV manhole cover, has a diameter of 30.125 inches. The open area of the manhole cover 100 is 12 inches or less wide by 12 inches or less deep. The hinged access portion 108 is less than 12 inches wide (i.e., from left to right in the figures) and less than 12 inches deep (not including the hinge 112). For example, the hinged access portion 108 can be, for example, 11.1875 inches wide and 11.25 inches deep. The diameter of the hinge 112 is 0.5 inch. The manhole cover 100 of FIG. 4A has 26 slats and 7 lateral bracings 106. The slats are 1 inch thick (i.e., from top to bottom) and 0.1875 inch wide.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A manhole cover, comprising:

a frame located at the edges of the manhole cover which completely surrounds the manhole cover;

a plurality of slats that are spaced apart and parallel to each other;

a plurality of lateral bracings that are spaced apart and parallel to each other, wherein the lateral bracings are perpendicular to the slats; and a hinged access portion located in the center of the manhole cover that is connected to a main portion of the manhole cover by a hinge, and all edges of the hinged access portion are spaced away from the frame, wherein the spaces formed between the plurality of slats and the plurality of bracings, in the hinged access portion and in the main portion of the manhole cover, are completely open and configured to allow air or fluid to flow therethrough.

2. The manhole cover of claim 1, wherein the hinged access portion has an area of one square foot or less.

3. The manhole cover of claim 1, wherein the hinged access portion is rectangularly shaped.

4. The manhole cover of claim 1, wherein the hinged access portion is square shaped.

5. The manhole cover of claim 1, wherein the manhole cover has an upper surface and a lower surface, and the hinge is located completely within the upper surface and the lower surface.

6. The manhole cover of claim 1, wherein the hinge is parallel to the lateral bracings.

7. The manhole cover of claim 1, wherein the hinge is continuous along the length of the hinged access portion.

8. The manhole cover of claim 5, wherein the lower surface has at least two supporting pieces that support a lower surface of the hinged access portion when it is in the closed position.

9. The manhole cover of claim 8, wherein the at least two supporting pieces are L-shaped brackets.

10. The manhole cover of claim 1, wherein the frame is circular.

11. The manhole cover of claim 1, wherein the lateral bracings are cylindrical rods or rectangular braces that are connected to two portions of the frame and to some or all of the plurality of slats.

12. The manhole cover of claim 1, wherein the lateral bracings are equally spaced apart from each other.

13. The manhole cover of claim 1, wherein the number of lateral bracings is between 1 and 50.

14. The manhole cover of claim 1, wherein all of the lateral bracings are in the same horizontal plane.

15. The manhole cover of claim 1, wherein the slats are equally spaced apart from each other.

16. The manhole cover of claim 1, wherein the number of slats is between 1 and 50.

17. The manhole cover of claim 1, wherein the manhole cover is 1 to 12 inches thick, and the slats have a height of 1 to 12 inches.

18. The manhole cover of claim 1, wherein the frame is circular and has a thickness in the radial direction of 1 inch to 6 inches.

19. The manhole cover of claim 1, wherein the manhole cover has a uniform thickness.

20. The manhole cover of claim 1, wherein the manhole cover is made of aluminum, steel, iron, or composite.

21. The manhole cover of claim 8, wherein one of the at least two supporting pieces is on the side of the hinged access portion that the hinge is present.

22. The manhole cover of claim 1, wherein the lateral bracings are cylindrical rods.

* * * * *